US006111368A

United States Patent [19]

Luchaco

[11] Patent Number: 6,111,368

[45] **Date of Patent: *Aug. 29, 2000**

[54] SYSTEM FOR PREVENTING OSCILLATIONS IN A FLUORESCENT LAMP BALLAST

[75] Inventor: David G. Luchaco, Fogelsville, Pa.

[73] Assignee: Lutron Electronics Co., Inc., Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/938,651

[22] Filed: Sep. 26, 1997

[51] Int. Cl.[7] ..... H05B 41/00; H05B 41/14

[52] U.S. Cl. ..... 315/307; 315/225; 315/224; 315/307

[58] Field of Search ..... 315/307, 224, 315/225, DIG. 4, 297, 291, 244, 209 R, 247

[56] References Cited

U.S. PATENT DOCUMENTS

| | | | |
|---|---|---|---|
| Re. 32,901 | 4/1989 | Nilssen | 315/244 |
| Re. 32,953 | 6/1989 | Nilssen | 315/224 |
| 3,889,153 | 6/1975 | Pierce | 315/209 R |
| 4,005,335 | 1/1977 | Perper | 315/224 |
| 4,382,212 | 5/1983 | Bay | 315/225 |
| 4,398,126 | 8/1983 | Zuchtriegel | 315/127 |
| 4,503,363 | 3/1985 | Nilssen | 315/225 |
| 4,547,706 | 10/1985 | Krummel | 315/226 |
| 4,562,383 | 12/1985 | Kerscher et al. | 315/225 |
| 4,616,158 | 10/1986 | Krummel et al. | 315/225 |
| 4,667,131 | 5/1987 | Nilssen | 315/275 |
| 4,952,849 | 8/1990 | Fellows et al. | 315/307 |
| 5,004,955 | 4/1991 | Nilssen | 315/119 |
| 5,023,516 | 6/1991 | Ito et al. | 315/101 |
| 5,111,114 | 5/1992 | Wang | 315/115 |
| 5,311,102 | 5/1994 | Du | 315/205 |
| 5,321,337 | 6/1994 | Hsu | 315/219 |
| 5,387,846 | 2/1995 | So | 315/209 R |
| 5,394,062 | 2/1995 | Minarczyk et al. | 315/129 |
| 5,422,548 | 6/1995 | Yamashita et al. | 315/224 |
| 5,436,529 | 7/1995 | Bobel | 315/127 |
| 5,461,287 | 10/1995 | Russell et al. | 315/209 R |
| 5,475,284 | 12/1995 | Lester et al. | 315/209 R |
| 5,493,180 | 2/1996 | Bezdon et al. | 315/91 |
| 5,493,181 | 2/1996 | Shackle et al. . | |
| 5,528,147 | 6/1996 | Konopka . | |
| 5,563,477 | 10/1996 | Ribarich et al. | 315/307 |
| 5,572,094 | 11/1996 | Yamashita el al. | 315/307 |
| 5,574,335 | 11/1996 | Sun . | |
| 5,604,411 | 2/1997 | Venkitasubrahmanian et al. | 315/224 |
| 5,623,184 | 4/1997 | Rector . | |
| 5,635,799 | 6/1997 | Hesterman . | |
| 5,636,111 | 6/1997 | Griffin et al. . | |
| 5,650,694 | 7/1997 | Jayaraman et al. | 315/225 |
| 5,705,894 | 1/1998 | Krummel . | |
| 5,747,941 | 5/1998 | Shackle et al. . | |
| 5,751,115 | 5/1998 | Jayaraman et al. | 315/225 |
| 5,781,418 | 7/1998 | Chang et al. | 315/307 |

FOREIGN PATENT DOCUMENTS

| | | |
|---|---|---|
| 0061744 | 3/1981 | European Pat. Off. . |
| 0056889 | 8/1982 | European Pat. Off. . |
| 0061730 | 10/1982 | European Pat. Off. . |
| 0785704 | 7/1997 | European Pat. Off. . |
| 2288095 | 11/1990 | Japan . |
| 475296 | 3/1992 | Japan . |
| 878169 | 3/1996 | Japan . |
| 8124683 | 5/1996 | Japan . |
| 9266079 | 10/1997 | Japan . |
| 9270298 | 10/1997 | Japan . |

*Primary Examiner*—Don Wong
*Assistant Examiner*—Wilson Lee
*Attorney, Agent, or Firm*—Ostrolenk, Faber, Gerb & Soffen, LLP

[57] ABSTRACT

A ballast adapted to power a fluorescent lamp as a function of a variable input signal, includes a power stage for providing power to a fluorescent lamp; a control circuit for controlling the power stage as a function of the variable input signal; a control circuit power supply for supplying control power to the control circuit; and a monitor and enabling circuit which permits the ballast to provide power to the lamp only when characteristics of the variable input signal meet predetermined criteria.

60 Claims, 5 Drawing Sheets

SYSTEM FOR PREVENTING OSCILLATIONS IN A FLUORESCENT LAMP BALLAST

BACKGROUND OF THE INVENTION

1. Field of the Invention

The present invention relates to lamp ballasts and, more particularly, to electronic dimming ballasts coupled to two wire phase controlled dimmers.

2. Related Art

With reference to FIG. 1, a prior art lamp system 10 includes an AC source 100 such as 120 VRMS, 60 Hz wall power, a phase controlled dimmer 102, an electronic dimmable fluorescent ballast 200, and a fluorescent lamp 300.

The ballast 200 receives input power (or hot, H) on line 202, a variable input signal (or dimmed hot, DH) on line 204, and neutral N on line 206 which is given a conventional ground symbol. It is understood that the voltages on lines 202 and 204 are rectified (for example, by full wave bridge rectifiers, not shown) within the ballast 200 to yield voltages having a positive DC average value with respect to neutral (or ground).

The electronic dimming ballast 200 is designed to provide an amount of output power to the lamp 300 in accordance with the variable input signal on line 204 from the dimmer 102. It is understood that the phase controlled dimmer 102 provides the variable input signal on line 204 by varying its phase firing angle which controls the RMS value of the variable input signal, discussed in more detail below.

As is known in the art, the ballast 200 typically includes a first power stage comprising a boost circuit 210 which receives a rectified version of the voltage on line 202 and produces a high DC voltage on line 214 which may reach 400 VDC or more.

The ballast 200 also typically includes a second power stage comprising an inverter circuit 216 (for example, a resonant converter) which converts the DC voltage on line 214 into a suitable AC voltage to drive the lamp 300. A high voltage energy storage capacitor 212 is provided in a shunt configuration with respect to line 214 to provide a low impedance source of current to the inverter 216.

The power delivered to the lamp 300 is typically provided via an output transformer 218 having a primary winding 218*a* and a secondary winding 218*b*. The transformer 218 also typically includes another secondary winding 218*c*, discussed below.

A control circuit 220 provides control signals and control power to the boost circuit 210 and inverter 216 over lines 221 and 222, respectively. The control circuit 220 commands the power stages (boost circuit 210 and inverter 216) to turn on or to turn off depending on certain conditions discussed below. The control signals provide information necessary to command the power stages to produce the current and voltage over line 208 which correspond with the variable voltage on line 204 such that the lamp 300 is illuminated at the proper intensity.

The control circuit 220 typically controls the inverter 216, for example, by comparing a rectified version of the variable input signal on line 204 with a signal representative of the current delivered to the lamp over line 208 and (via known error signal techniques) adjusting the control signals input to the inverter 216 over line 222 to command the proper current to the lamp 300.

As is known in the art, the control circuit 220 also commands the boost circuit 210 to produce the proper DC output voltage on line 214. Further, the control circuit 220 typically includes circuits which perform other functions such as low voltage lockout, over-current protection, over-voltage protection and the like.

The control circuit 220, boost circuit 210 and inverter circuit 216 require relatively low voltage power (or control power) to perform the conversion of the input power on line 202 to the output power on line 208. Control power is typically provided by a 15 V control circuit power supply (also known as a Vcc supply) which can deliver about 40–50 ma of current, although other voltage levels and currents may be required.

In the embodiment shown in FIG. 1, control power is provided by a control circuit power supply 240 comprising the following circuit elements: resistor 224, diode 228, low voltage storage capacitor 230, voltage regulator 232 (shown as a Zener diode), diode 229 and secondary winding 218*c* of the output transformer 218 of the inverter 216. It is understood that the control circuit power supply 240 may be implemented using many other circuit configurations.

The operation of the control circuit power supply 240 is now described. At start up, the lamp 300 is off and there is no output voltage on secondary winding 218*c*. Resistor 224, however, provides current from the input power on line 202 through diode 228 to the low voltage storage capacitor 230. The current flowing through resistor 224 to capacitor 230 produces a voltage across capacitor 230 which is sufficient to "start up" the control circuit 220 and power stages 210, 216.

The voltage regulator 232 is typically employed to ensure that the voltage across capacitor 230 does not exceed a predetermined value, for example, about 15 VDC. A Zener diode, three terminal regulator, or the like may be used for the voltage regulator 232.

The value of resistor 224 is selected such that the "trickle" current drawn from line 202 and the power dissipated in resistor 224 do not significantly affect the efficiency of the ballast 200 or overheat it. Typically, the trickle current drawn through resistor 224 does not exceed about 1–4 ma.

The current required from the control circuit power supply 240 over line 231 during normal operation of the ballast (i.e., when the power stages are substantially continuously supplying power to the lamp) is typically in the range of about 40–50 ma. The current provided through resistor 224 to the control circuit power supply 240 during start up is significantly below this level and is insufficient to operate the ballast 200 in normal operation. The amount of current provided through resistor 224 to the control circuit power supply 240, however, is high enough to charge capacitor 230 to a sufficiently high voltage to operate the boost circuit 210 and the inverter circuit 216 for a short time which enables the ballast 200 to start momentarily.

Once the inverter 216 is started, the low voltage storage capacitor 230 of the control circuit power supply 240 receives current from the secondary winding 218*c* of the output transformer 218 of the inverter 216 through diode 229. The turns ratio of the secondary winding 218*c* to the primary winding 218*a* is set to achieve the appropriate low voltage DC level across capacitor 230. The secondary winding 218*c* of the output transformer 218 provides sufficient current to the control circuit power supply 240 to operate the ballast 200 during normal operation.

The lamp system 10 of FIG. 1 has, among others, the drawback of requiring three wires between the dimmer 102 and the ballast 200, which is usually located in the light fixture itself. Consequently, the use of a fluorescent lamp dimming ballast in situations where only two wire cabling has been installed is problematic. Indeed, it is typically inconvenient or impossible to add the necessary control line 204.

One possible way to avoid the need for a three wire system is to modify the known system of FIG. 1 in the manner shown in FIG. 2. In this system the variable input signal from the dimmer 102 is connected to both lines 202 and 204 of the ballast 200. The connection between line 202 and 204 is typically provided inside the ballast 200 thus eliminating the need for a third terminal on the ballast 200 for receiving the variable input signal on line 204.

The ballast 200 of FIG. 2 operates in substantially the same way as the circuit of FIG. 1 which is advantageous in that no additional wiring is required to add dimming capability to the fluorescent lamp 300.

Although the system 10 of FIG. 2 avoids the problem of requiring three wires for dimming, it suffers from another substantial drawback because the ballast 200 may enter an oscillatory mode in which it repeatedly starts up, stops and starts up again. The above mentioned oscillatory mode occurs when the dimmer 102 is set to an insufficient phase conduction angle and, as discussed below, is encountered under two sets of circumstances.

With reference to FIG. 3, the phase conduction characteristics of the dimmer circuit 102 are now discussed. The variable input signal labeled 202*a* in FIG. 3 is output from a fully "on" dimmer 102 which conducts at a phase conduction angle, $\phi$, of about 0°. The variable input signal labeled 202*b* is output from a dimmer 102 which conducts at some phase conduction angle, $\phi$, between about 0° and 180°.

High phase conduction angles (i.e., greater than about 90°) correspond with low values for the peak voltage Vp on line 202 in FIG. 2. The portions of the variable input signal labeled 202*b* between 0° and $\phi$1 and between $\phi$2 and $\phi$3 are called the "dead time" or "non-conduction phase periods." The portions of the variable input signal labeled 202*b* between $\phi$1 and $\phi$2 and between $\phi$3 and $\phi$4 are called the "conduction time" or "conduction phase periods."

The system of FIG. 2 enters the oscillatory mode when the conduction phase period (which may be measured in terms of phase angle, $\phi$) or the conduction time (which may be measured in terms of time, ms) is too small. During a small phase conduction period, the peak voltage Vp on line 202 is too low to properly power the boost circuit 210, the inverter circuit 216, and/or the control circuit 220.

When the peak voltage Vp on line 202 is too low, the oscillatory mode may be triggered in two ways, namely, via over-current conditions in the boost circuit 210 or via insufficient voltage output from line 231 of the control circuit power supply 240.

Over-current triggering of the oscillatory mode is now discussed in more detail. The control circuit 220 includes an over-current protection circuit (not shown) which prevents the boost circuit 210 from drawing excessive current over line 202. It is understood that the over-current protection circuit may be disposed within the boost circuit 210 itself or another location.

When the peak voltage Vp on line 202 is too low, the boost circuit 210 may draw excessive current from line 202 in an attempt to produce the high DC voltage across capacitor 212 to power the inverter 216. This is so because the ballast 200 is designed to produce a minimum power output for the lamp 300 (i.e., just enough power to turn the lamp on) even though the dimmer 102 may be set at a high phase conduction angle (i.e., outputting a low peak voltage Vp).

Since the inverter 216 will attempt to output the minimum power level to the lamp 300 and the current drawn by the boost circuit 210 is inversely proportional to the voltage available on line 202 for a given power delivered to the lamp 300, the boost circuit 210 will draw higher currents from line 202 when the peak voltage Vp is reduced.

The higher currents drawn from line 202 will tend to trip the over-current protection circuit in the control circuit 220. By tripping the over-current protection circuit, the control circuit 220 commands the boost circuit 210 to shut down, thereby eliminating the excessive current draw by the boost circuit 210 and also shutting down the inverter 216. Thus, the filaments of the lamp 300 will have been heated (and the gas of the lamp 300 may or may not have glowed) momentarily until the boost circuit 210 reached the over-current condition.

Once the boost circuit 210 and the inverter 216 have been shut down for a sufficient period (determined by the design of the over-current protection circuit) the control circuit 220 will attempt to re-start the boost circuit 210 and the inverter 216. During the re-start, current is again drawn from line 202 and power is again delivered to the lamp 300. So long as the dimmer 102 is set at a relatively high phase conduction angle, however, the peak voltage Vp on line 202 will be too low and the boost circuit 210 will again draw excessive current. Therefore, the control circuit 220 will again shut down the boost circuit 210 and the inverter 216 and cycle power to the lamp 300.

Insufficient voltage output on line 231 from the control circuit power supply 240 may also trigger the oscillatory mode when the peak voltage Vp on line 202 is too low. The control circuit 220 includes a low voltage lockout circuit (not shown) which monitors the voltage on line 231 from the control circuit power supply 240 and shuts down the control circuit 220 (and thus the power stages) when the voltage on line 231 is too low, for example below about 10 volts.

Since the control circuit 220 and power stages draw more current from the control circuit power supply 240 after they have started, if the peak voltage Vp is too low, line 231 of the control circuit power supply 240 may not maintain a sufficiently high voltage to the control circuit 220. As a result, the voltage on line 231 of the control circuit power supply 240 may droop to the point where the low voltage lockout circuit of the control circuit 220 shuts down the power stages of the ballast 200.

After the control circuit 220 and power stages shut down, the current drawn from line 231 of the control circuit power supply 240 is reduced and the voltage on line 231 may again rise. Therefore, the low voltage lockout circuit of the control circuit 220 may again permit the power stages to start causing power to cycle in the lamp 300.

This endless cycling of power to the lamp 300 during the oscillatory mode of the ballast 200 is undesirable because the lamps are operated momentarily during each power cycle. It is well known that fluorescent lamps suffer an incremental amount of damage to their electrodes upon each start. A typical lamp will be at the end of its useful life after approximately 10,000 power cycles. Since the power cycling typically takes place at a rate of about once per second, 10,000 cycles of the lamp 300 (i.e., failure of the lamp 300) will occur after only three hours of operation in the oscillatory mode.

Even when the dimmer 102 does not fire at all during the AC line half cycles (i.e., the distance between $\phi$1 and $\phi$2 and the distance between $\phi$3 and $\phi$4 is zero degrees, the so-called "electronic off" state), the oscillatory mode of the ballast 200 can still take place. This is so because most good quality dimmers 102 contain a capacitor 104 across a semiconductor device (not shown) within the dimmer 102 to suppress RF interference. The capacitor 104 is typically of a size which allows a leakage current to flow from the AC source 100 over line 202, which leakage current is of a sufficient magnitude to charge the capacitor 230 and initiate the cycling described above. Since many dimmers now use the electronic off state instead of a switch contact (or "air-gap" off state), attempting to use a two-wire fluorescent ballast with such dimmers would again lead to very short lamp life.

Accordingly, there is a need in the art for a new ballast circuit which is capable of receiving power from a phase controlled dimmer over only two wires where the ballast will not enter an oscillatory mode when the dimmer is set to produce an output having a relatively low peak output voltage.

SUMMARY OF THE INVENTION

To overcome the drawbacks of the prior art ballast circuits, the present invention employs a ballast circuit which receives a variable input signal from a phase controlled dimmer and powers a fluorescent lamp. The ballast circuit includes a power stage for providing power to the lamp; a control circuit for controlling the power stage; a control circuit power supply for supplying control power to the control circuit; and a monitor and enabling circuit allowing the control circuit power supply to draw current from the variable input signal only when characteristics of the variable input signal meet predetermined criteria.

Other features and advantages of the present invention will become apparent from the following description-of the invention which refers to the accompanying drawings.

BRIEF DESCRIPTION OF THE DRAWINGS

For the purpose of illustrating the invention, there is shown in the drawing a form which is presently preferred, it being understood, however, that the invention is not limited to the precise arrangement and instrumentality shown.

DETAILED DESCRIPTION OF THE INVENTION

Figure 4:
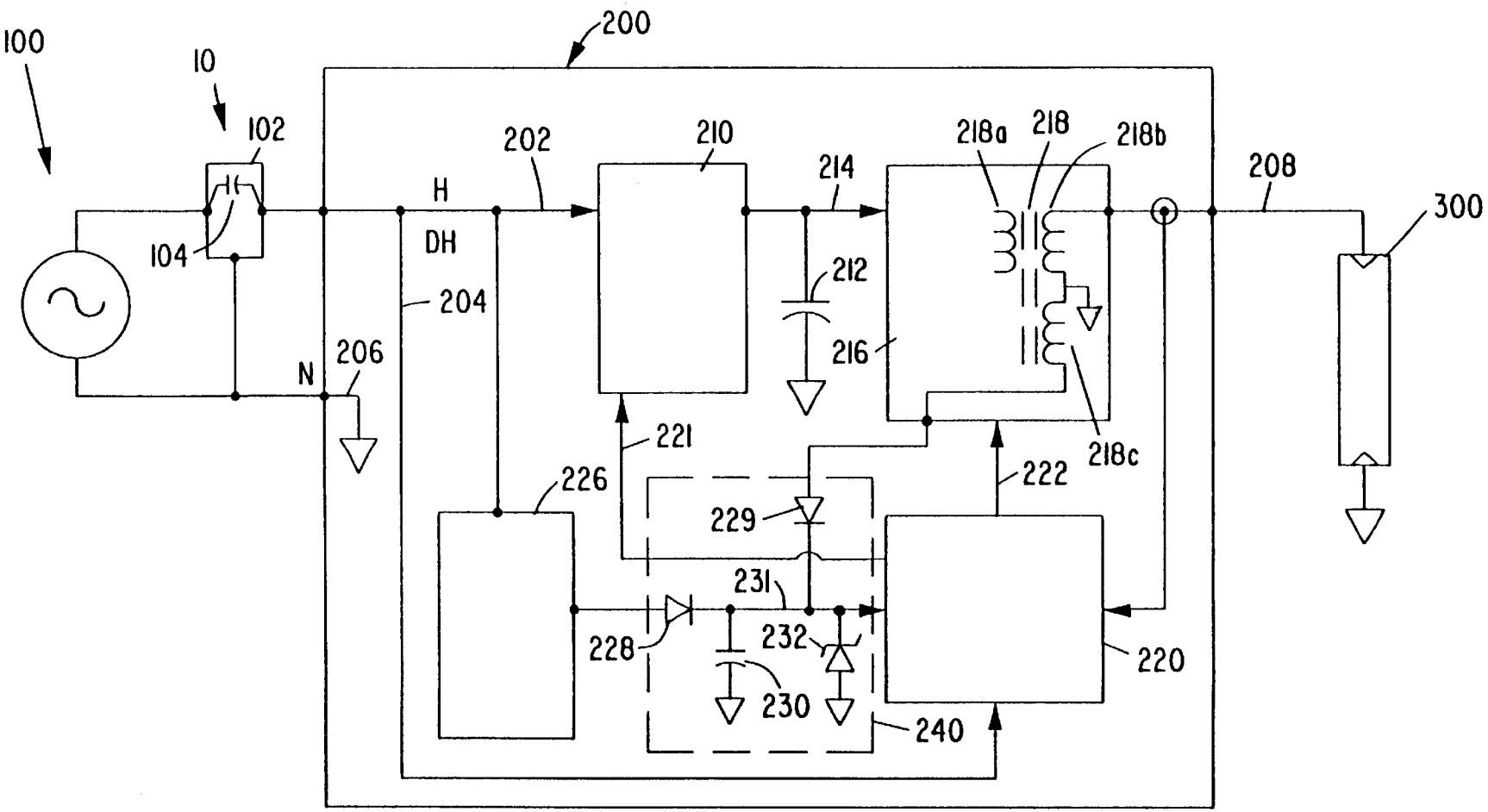
FIG. 4 is a schematic diagram of a fluorescent lamp circuit in accordance with the present invention.

Referring now to the drawings wherein like numerals indicate like elements, there is shown in FIG. 4 a schematic diagram of a fluorescent lamp circuit 10 in accordance with the present invention.

Figure 1:
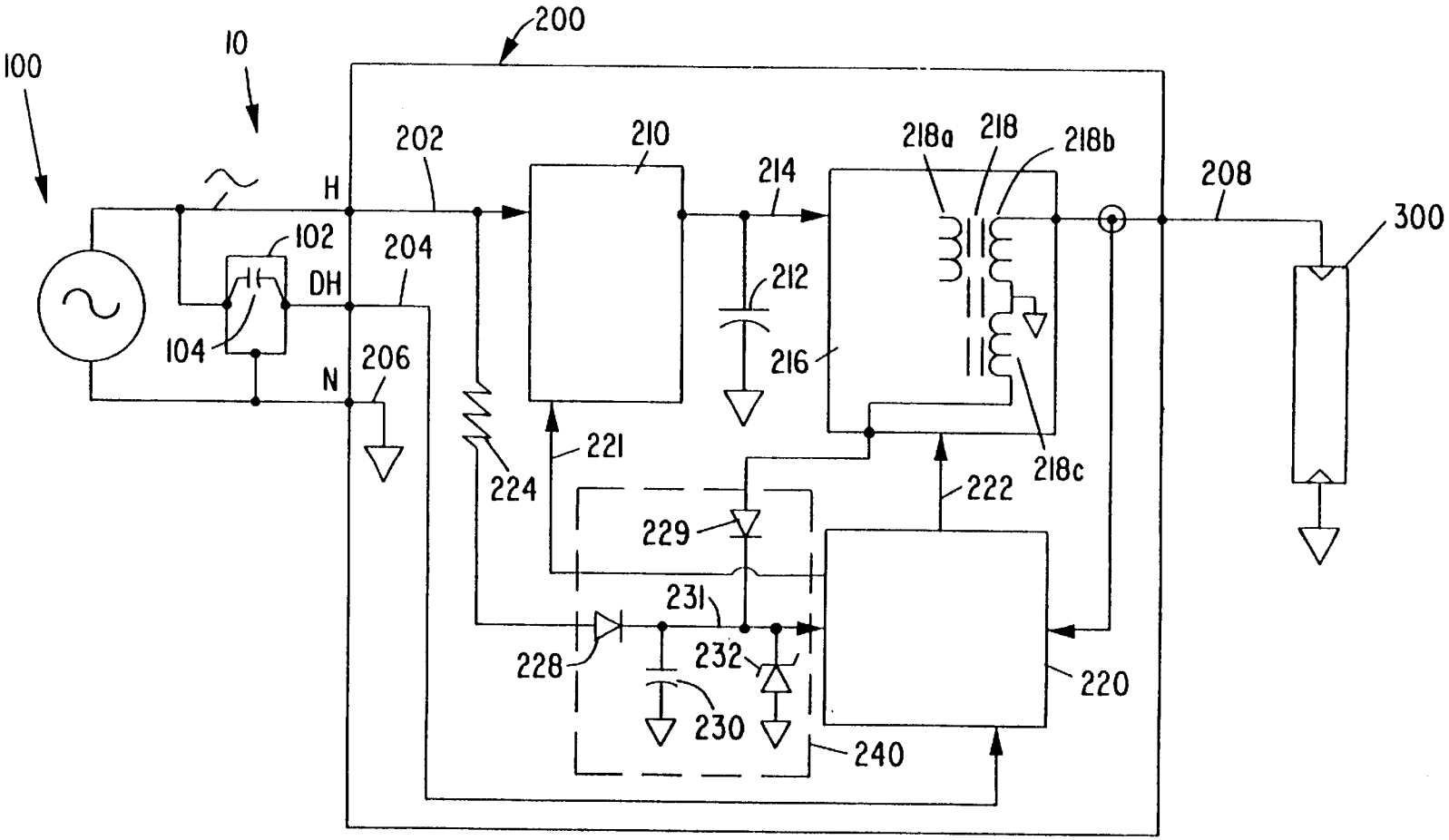
FIG. 1 PRIOR ART
FIG. 1 is a schematic diagram of a fluorescent lamp circuit of the prior art.
Figure 2:
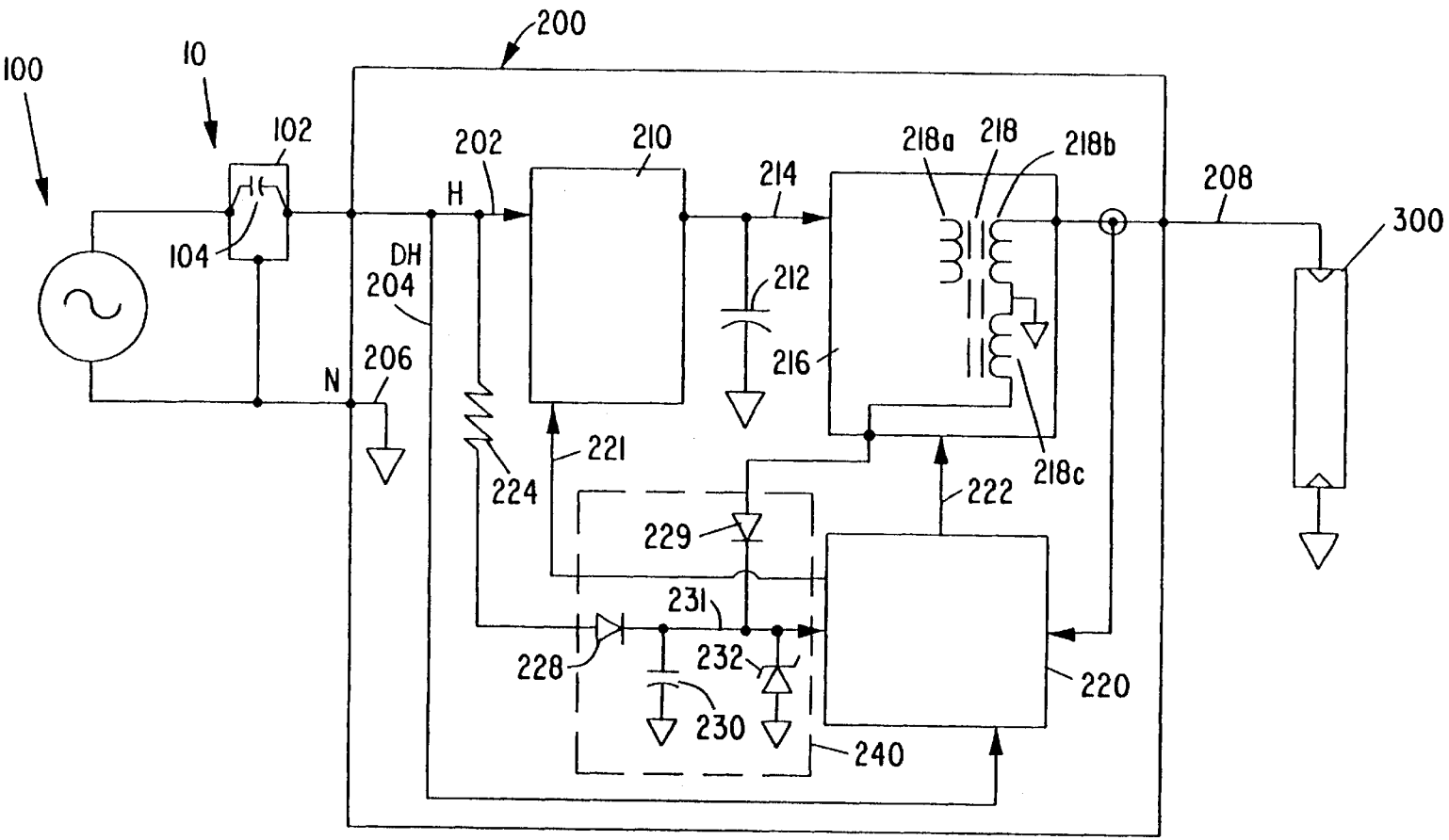
FIG. 2 PRIOR ART
FIG. 2 is a schematic diagram of a possible modification of the fluorescent lamp circuit of FIG. 1.
Figure 3:
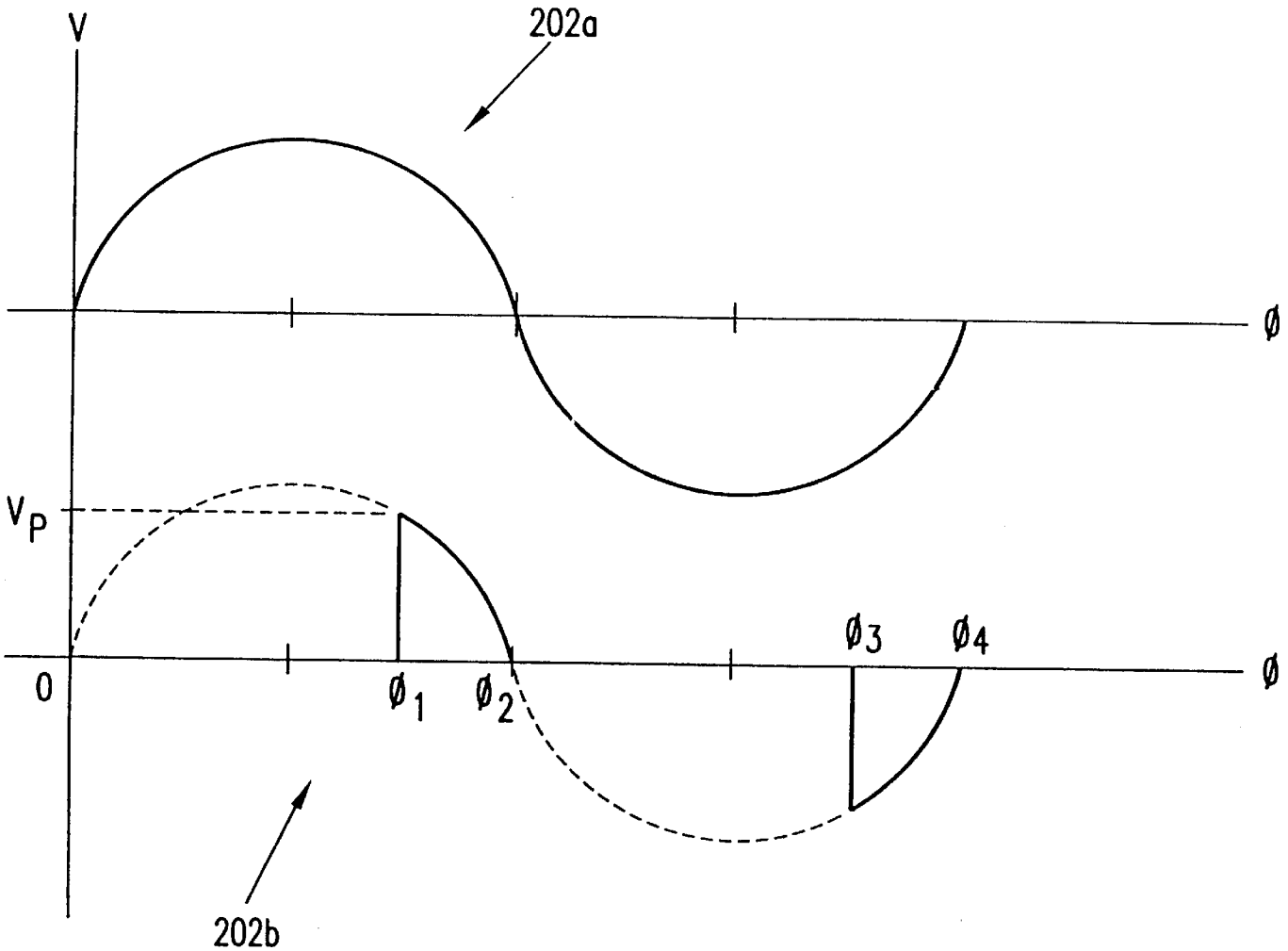
FIG. 3 is a graphical representation of the output from the phase controlled dimmer circuit of the circuits of FIGS. 1 and 2.

The lamp circuit 10 operates in a similar manner as the circuit of FIG. 2 except that it includes a monitor and enabling circuit 226 which eliminates the oscillatory mode encountered in the prior art lamp circuits.

The monitor and enabling circuit 226 operates as a detection circuit and switch to operatively couple the variable input signal on line 202 (or 204) to the control circuit power supply 240, namely, line 231 only when one or more specified conditions are met. It is preferred that the monitor and enabling circuit 226 only operatively couple the variable input signal on line 202 to the control circuit power supply 240 when the characteristics of the variable input signal are such that the ballast circuit 200 will remain in normal operation (i.e., such that the power stages will substantially continuously supply power to the lamp).

The characteristics of the variable input signal on line 202 are preferably that variable input signal has: (i) a minimum average voltage (or a minimum RMS voltage); (ii) a minimum predetermined peak voltage level Vp; (iii) a minimum conduction time period; and/or (iv) a minimum phase conduction period.

Since the wave-shape of the variable input signal on line 202 is predictable (e.g., it has a substantially sinusoidal shape), it is understood that a minimum average voltage may be attained when a minimum predetermined peak voltage Vp is attained.

A predetermined minimum value for the peak voltage Vp of the variable input signal on line 202 is chosen such that, at that minimum value, the ballast circuit 200 remains in normal operation. More particularly, it is preferred that the predetermined minimum value for the peak voltage Vp of the variable input signal on line 202 is chosen such that the boost circuit 210 will not draw excessive current over line 202.

When the AC source 100 is a 120V RMS, 60 Hz AC line, it has been found that a predetermined minimum value for the peak voltage Vp of the variable input signal on line 202 of about 110 V will permit the power stage of the ballast 200 to remain in normal operation and avoid entering into the oscillatory mode. It has also been found that the predetermined minimum value for the peak voltage Vp of the variable input signal on line 202 of about 110 V will ensure that the control circuit power supply 240 produces a sufficiently high output voltage level on line 231 to prevent the low voltage lockout circuit of the control circuit 220 from shutting down the ballast 200.

Thus, the monitor and enabling circuit 226 may be configured to monitor the peak voltage Vp of the variable input signal from the dimmer 102 on line 202. When the monitor and enabling circuit 226 is so configured, it prevents current flow from line 202 to the control circuit power supply 240 until the dimmer 102 is set to permit a peak voltage Vp of about 110 V on line 202. Consequently, the ballast 200 will not even attempt to power the lamp 300 until the peak voltage Vp of the variable voltage on line 202 has reached the predetermined minimum level, i.e., 110 V and the oscillatory mode will be avoided.

To avoid the oscillatory mode, the minimum conduction time and the minimum phase conduction period of the variable input signal on line 202 are chosen such that the power stages of the ballast 200 will remain in normal operation. In addition, the minimum conduction time and the minimum phase conduction period are selected to ensure that the control circuit power supply 240 produces a sufficiently high output voltage level to prevent the low voltage lockout circuit of the control circuit 220 from shutting down the ballast 200.

When the AC source 100 is a 120V RMS, 60 Hz AC line, it has been found that a minimum conduction time of about 2.5 ms, or a minimum phase conduction period of about 54.2°, would permit the power stage of the ballast 200 to remain in normal operation and avoid entering into the oscillatory mode. The minimum conduction time period of about 2.5 ms and the minimum phase conduction period of about 54.2° correspond to a peak voltage Vp on line 202 of about 110 V for a 60 Hz, 120 VRMS AC source 100. The minimum conduction time of 2.5 ms and the minimum phase conduction period of 54.2° correspond to about 30% of the full conduction period available.

Thus, the monitor and enabling circuit 226 may be configured to monitor the minimum conduction time and/or the minimum phase conduction period of the variable input signal from the dimmer 102 on line 202. When the monitor and enabling circuit 226 is so configured, it prevents current flow from line 202 to the control circuit power supply 240 until the dimmer 102 is set to permit a minimum conduction time of about 2.5 ms or a minimum phase conduction period of about 54.2° on line 202. Consequently, the ballast 200 will not even attempt to power the lamp 300 until one of the above conditions for normal operation are met and the oscillatory mode will be avoided.

The problem of leakage current flowing through the capacitor 104 of the dimmer 102 is now discussed in more detail. Irrespective of which characteristic(s) of the variable input signal on line 202 the monitor and enabling circuit 226 is sensitive to (for example, voltage, phase period and/or time period), the leakage current value in the electronic off state is quite low compared to the currents drawn over line 202 during normal operation of the ballast 200.

Therefore, it is possible to design the ballast 200 such that the voltage on line 202 is lower than 110 volts during the electronic off state and that the control circuit 220 will not attempt to command the ballast 200 to start up. For example, a relatively high value resistor (which does not draw significant current from line 202) may be connected in a shunt configuration from line 202 to ground (not shown). With such a configuration, when the dimmer 102 is in the electronic off state, the shunt resistor will lower the voltage on line 202 below 110 V. When the dimmer 102 is providing a variable input signal on line 202, however, the high value resistor will not significantly pull the voltage on line 202 down and the circuit will operate as discussed above.

Although the monitor and enabling circuit 226 may be configured to detect the peak voltage Vp, the conduction time, and/or the conduction phase period of the variable input signal on line 202, for simplicity and cost reasons detection of the peak voltage Vp is preferred.

Figure 5:
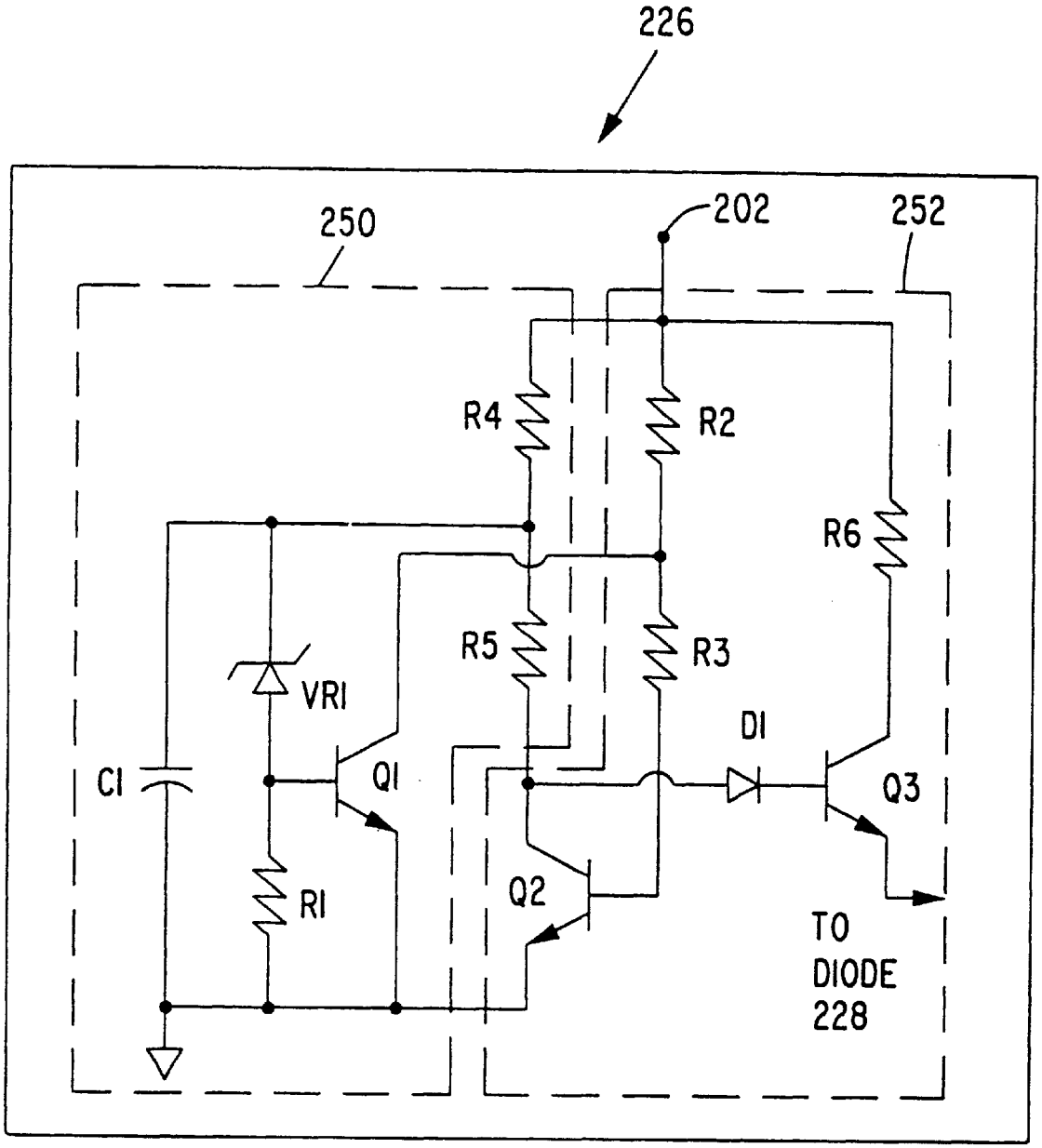
FIG. 5 is a schematic diagram of a preferred monitor and enabling circuit in accordance with the present invention.

Referring to FIG. 5, a schematic diagram of a preferred monitor and enabling circuit 226 is shown. The monitor and enabling circuit 226 of FIG. 5 is configured to detect the peak voltage Vp on line 202 and to permit current to flow from line 202 to the control circuit power supply 240 only when the peak voltage Vp on line 202 is at least about 110 V.

The monitor and enabling circuit 226 of the preferred embodiment of the present invention as shown in FIG. 5 includes a voltage detection stage 250 comprising Zener diode VR1, transistor Q1, capacitor C1 and associated resistors. The monitor and enabling circuit 226 also includes a switching circuit 252 comprising transistors Q2, Q3, diode D1 and associated resistors.

The operation of the circuit of FIG. 5 is now described. Initially, it is assumed that the peak voltage Vp on line 202 is less than about 110 V and, therefore, Zener diode VR1 is not conducting base current into Q1 (i.e., Q1 is off), R2 and R3 are conducting base current into Q2 (i.e., Q2 is on) and Q2 is preventing base current from flowing into Q3 (i.e., Q3 is off). Thus, no current flows from line 202 to control circuit power supply 240.

Since transistor Q2 is on (i.e., Q2 is operating in its saturation region), R4 and R5 form a voltage divider from line 202 to ground which is designed to reach about 18 V when the voltage on line 202 reaches about 110 V. Zener diode VR1 is selected to conduct current when about 18 V is impressed across it and, therefore, transistor Q1 will receive base current through VR1 only when the peak voltage Vp on line 202 reaches or exceeds about 110 V.

Therefore, when the peak voltage Vp on line 202 reaches about 110 V, transistor Q1 turns on and prevents base current from flowing into transistor Q2, turning Q2 off. Once transistor Q2 turns off, base current flows into transistor Q3 via R4, R5 and D1, turning Q3 on and allowing current to flow from line 202 to the control circuit power supply 240.

It is noted that C1 is included to reduce noise in the voltage detection stage 250 and avoid undesirable commutation of the transistors Q1, Q2, and/or Q3.

Hysteresis (which prevents undesirable switching oscillation of transistors Q1, Q2 and Q3) is introduced into the voltage detecting stage 250 when the voltage at the common node between R4 and R5 rises in accordance with the voltage at the input to control circuit power supply 240 added with the base emitter voltage of Q3 and the forward voltage drop of D1. Thus, once the peak voltage Vp on line 202 reaches about 110 V and Q3 turns on, the peak voltage on line 202 will have to drop slightly below about 110 V before Q3 will again turn off.

Irrespective of whether the monitor and enabling circuit 226 is configured to detect the peak voltage Vp, the conduction time, and/or the conduction phase period of the variable input signal on line 202, the monitor and enabling circuit 226 may be improved by adding circuitry to detect that the ballast 200 has begun to operate normally. This may be accomplished by feeding back a signal from the boost circuit 210, the inverter 216 and/or the control circuit 220 which commands the monitor and enabling circuit 226 to interrupt current flow from line 202 to the control circuit power supply 240 when the power stages are operating in normal operation.

An example of the feedback described above will now be presented. With reference to FIG. 5, a control signal from the boost circuit 210, the inverter 216 and/or the control circuit 220 which presents a high impedance at start up but sinks current to ground when the power stages are in normal operation may be connected to the base of Q1. Thus, when the power stages enter their normal operating mode, Q1 turns off, Q2 turns on and Q3 turns off even though the peak voltage Vp on line 202 is at or above 110 V.

Thus, once the ballast 200 is running, the trickle current to the control circuit power supply 240 is no longer needed and is shut off, thereby reducing power dissipation, improving the energy efficiency and lowering the operating temperature of the ballast 200.

Although the present invention has been described in relation to particular embodiments thereof, many other variations and modifications and other uses will become apparent to those skilled in the art.

For example, the monitor and enabling circuit 226 may be adapted to permit either the boost circuit 210, the inverter 216, and/or the control circuit 220 to operate only when the characteristics of the variable input signal meet predetermined criteria. Indeed, the monitor and enabling circuit 226 may be adapted to only permit the ballast 200 to operate only when the characteristics of the variable input signal meet predetermined criteria.

Further, it will be apparent to those skilled in the art from the above teaching that the monitor and enabling circuit 226 may be adapted to monitor the average voltage and/or the RMS voltage of the variable input signal on line 202 in order to control the switching circuit 252.

It is preferred, therefore, that the present invention be limited not by the specific disclosure herein, but only by the appended claims.

What is claimed is:

1. A ballast for providing power to a fluorescent lamp from a substantially sinusoidal source of input power having variable conduction and non-conduction periods, the ballast comprising:

a power stage for converting the input power to drive the fluorescent lamp;

a control circuit for controlling the power stage as a function of the variable conduction and non-conduction periods;

a control circuit power supply operable to draw power from the input power source and provide control power to the control circuit; and a monitor and enabling circuit which permits the ballast to deliver power to the lamp only when characteristics of the input power source meet predetermined criteria.

2. The ballast of claim 1, wherein the criteria include that the characteristics of the input power source are such that the power stage is capable of delivering power to the lamp on a substantially uninterrupted basis in response thereto.

3. The ballast of claim 2, wherein the criteria include that the voltage characteristics of the input power source are such that the power stage is capable of delivering power to the lamp on a substantially uninterrupted basis in response thereto.

4. The ballast of claim 3, wherein the criteria include that the input power source has a peak voltage level at or above a predetermined value.

5. The ballast of claim 4, wherein the predetermined value of the peak voltage of the input power source is about 110 volts.

6. The ballast of claim 3, wherein the criteria include that the input power source has at least one of an average rectified voltage and an RMS voltage which is at or above a predetermined value.

7. The ballast of claim 1, wherein the criteria include that conduction time period characteristics of the input power source are such that the power stage is capable of delivering power to the lamp on a substantially uninterrupted basis in response thereto.

8. The ballast of claim 7, wherein the criteria include that the input power source has a conduction time period at or above a predetermined value.

9. The ballast of claim 8, wherein the predetermined value of the conduction time period of the input power source is about 30% of a full conduction time period.

10. The ballast of claim 8, wherein the predetermined value of the conduction time period of the input power source is about 2.5 ms.

11. The ballast of claim 1, wherein the criteria include that conduction phase period characteristics of the input power source are such that the power stage is capable of delivering power to the lamp on a substantially uninterrupted basis in response thereto.

12. The ballast of claim 11, wherein the criteria include that the input power source has a conduction phase period at or above a predetermined value.

13. The ballast of claim 12, wherein the predetermined value of the conduction phase period of the input power source is about 30% of a full conduction period.

14. The ballast of claim 12, wherein the predetermined value of the conduction phase period of the input power source is about 54°.

15. The ballast of claim 1, wherein the monitor and enabling circuit is operable to permit the control circuit power supply to deliver power to the control circuit only when characteristics of the input power source meet the predetermined criteria.

16. The ballast of claim 15, wherein the monitor and enabling circuit is operable to permit current to flow from the control circuit power supply to the control circuit only when characteristics of the input power source meet the predetermined criteria.

17. The ballast of claim 15, wherein the monitor and enabling circuit is operable to permit current to flow from the input power source to the control circuit power supply only when characteristics of the input power source meet the predetermined criteria.

18. The ballast of claim 17, wherein the criteria include that the voltage characteristics of the input power source are such that the power stage will not exhibit an over current condition in response to the characteristics of the input power source.

19. The ballast of claim 18, wherein the criteria include that the input power source has a peak voltage level at or above a predetermined value.

20. The ballast of claim 19, wherein the predetermined value of the peak voltage of the input power source is about 110 volts.

21. The ballast of claim 17, wherein the criteria include that voltage characteristics of the input power source are such that the control circuit power supply is capable of delivering enough power to the control circuit so that the power stage is commanded to deliver power to the lamp on a substantially uninterrupted basis.

22. The ballast of claim 17, wherein the criteria include that voltage characteristics of the input power source are such that the control circuit power supply is capable of delivering enough voltage to the control circuit so that the power stage is commanded to deliver power to the lamp on a substantially uninterrupted basis.

23. The ballast of claim 17, wherein the criteria include that voltage characteristics of the input power source are such that the control circuit power supply is capable of delivering enough current to the control circuit so that the power stage is commanded to deliver power to the lamp on a substantially uninterrupted basis.

24. The ballast of claim 22, wherein the criteria include that the input power source has a peak voltage level at or above a predetermined value.

25. The ballast of claim 24, wherein the predetermined value of the peak voltage of the input power source is about 110 volts.

26. The ballast of claim 1, wherein the monitor and enabling circuit permits the power stage to operate only when characteristics of the input power source meet the predetermined criteria.

27. The ballast of claim 26, wherein the criteria include that the input power source has a peak voltage level at or above a predetermined value.

28. The ballast of claim 26, wherein the power stage includes a boost circuit and the monitor and enabling circuit permits the boost circuit to operate only when characteristics of the input power source meet the predetermined criteria.

29. The ballast of claim 26, wherein the power stage includes an inverter circuit and the monitor and enabling circuit permits the inverter circuit to operate only when characteristics of the input power source meet the predetermined criteria.

30. The ballast of claim 1, wherein the monitor and enabling circuit includes a monitoring stage and a switching stage, the switching stage permitting the ballast to deliver power to the lamp only when the monitoring stage indicates that the characteristics of the input power source meet predetermined criteria.

31. The ballast of claim 30, wherein the monitor and enabling circuit is operable to permit current to flow from the input power source to the control circuit power supply only when characteristics of the input power source meet the predetermined criteria.

32. The ballast of claim 30, wherein the power stage is operatively coupled to the control circuit power supply such that the power stage supplies current to the control circuit power supply only after the power stage is providing power to the lamp.

33. The ballast of claim 32, wherein the control circuit is operatively coupled to the monitor and enabling circuit such that the input power source is uncoupled from the control circuit power supply when the power stage is providing power to the lamp.

34. The ballast of claim 30, wherein the monitoring stage is operable to receive a signal representative of the input power source and provides control to the switching stage such that the input power source is operatively coupled to the control circuit power supply when characteristics of the input power source meet the predetermined criteria.

35. The ballast of claim 34, wherein the monitoring stage monitors the characteristics of the input power source and provides control to the switching stage to couple the input power source to the control circuit power supply when the characteristics of the input power source are such that the power stage is capable of delivering power to the lamp on a substantially uninterrupted basis in response thereto.

36. The ballast of claim 35, wherein the monitor stage controls the switching stage to couple the input power source to the control circuit power supply when the voltage characteristics of the input power source indicate that the input power source has a peak voltage level at or above a predetermined value.

37. The ballast of claim 36, wherein the predetermined value of the peak voltage of the input power source is about 110 volts.

38. The ballast of claim 35, wherein the monitor stage controls the switching stage to couple the input power source to the control circuit power supply when conduction time period characteristics of the input power source indicate that it has a conduction time period at or above a predetermined value.

39. The ballast of claim 38, wherein the predetermined value of the conduction time period of the input power source is about 30% of full conduction time period.

40. The ballast of claim 38, wherein the predetermined value of the conduction time period of the input power source is about 2.5 ms.

41. The ballast of claim 35, wherein the monitor stage controls the switching stage to couple the input power source to the control circuit power supply when phase conduction period characteristics of the input power source indicate that it has a phase conduction period at or above a predetermined value.

42. The ballast of claim 41, wherein the predetermined value of the phase conduction period of the input power source is about 30% of full conduction period.

43. The ballast of claim 41, wherein the predetermined value of the phase conduction period of the input power source is about 54°.

44. A ballast for providing power to a fluorescent lamp from a substantially sinusoidal source of input power having variable conduction and non-conduction periods, the ballast comprising:

a power stage for converting the input power to drive the lamp;

a control circuit for controlling the power stage;

a control circuit power supply operable to draw power from the input power source and provide control power to the control circuit;

the control circuit being operable to turn the power stage off when the power stage is not capable of delivering power to the lamp on a substantially uninterrupted basis in response to the input power source; and a monitor and enabling circuit operable to permit the control circuit power supply to draw current from the input power source only when characteristics of the input power source meet predetermined criteria.

45. The ballast of claim 44, wherein the monitor and enabling circuit permits the control circuit power supply to draw current from the input power source when voltage characteristics of the input power source are such that the power stage is capable of delivering power to the lamp on a substantially uninterrupted basis in response thereto.

46. The ballast of claim 45, wherein the monitor and enabling circuit permits the control circuit power supply to draw current from the input power source when the input power source has a peak voltage level at or above a predetermined value.

47. The ballast of claim 45, wherein the monitor and enabling circuit permits the control circuit power supply to draw current from the input power source when the input power source has at least one of an average rectified voltage and an RMS voltage which is at or above a predetermined value.

48. The ballast of claim 44, wherein the monitor and enabling circuit permits the control circuit power supply to draw current from the input power source when conduction period characteristics of the input power source are such that the power stage is capable of delivering power to the lamp on a substantially uninterrupted basis in response thereto.

49. The ballast of claim 48, wherein the monitor and enabling circuit permits the control circuit power supply to draw current from the input power source when the input power source has a conduction time period at or above a predetermined value.

50. The ballast of claim 49, wherein the predetermined value of the conduction time period of the input power source is about 30% of a full conduction time period.

51. The ballast of claim 49, wherein the predetermined value of the conduction time period of the input power source is about 2.5 ms.

52. The ballast of claim 48, wherein the monitor and enabling circuit permits the control circuit power supply to draw current from the input power source when the input power source has a phase conduction period at or above a predetermined value.

53. The ballast of claim 52, wherein the predetermined value of the phase conduction period of the input power source is about 30% of a full phase conduction period.

54. The ballast of claim 52, wherein the predetermined value of the phase conduction period of the input power source is about 54°.

55. A ballast for providing power to a fluorescent lamp from a substantially sinusoidal source of input power having variable conduction and non-conduction periods, the ballast comprising:

a power stage for converting the input power to drive the lamp;

a control circuit for controlling the power stage;

a control circuit power supply operable to draw power from the input power source and provide control power to the control circuit; and a monitor and enabling circuit including a monitoring stage and a switching stage, the switching stage permitting the ballast to deliver power to the lamp only when the monitoring stage indicates that the characteristics of the input power source meet predetermined criteria.

56. The ballast of claim 55, wherein the monitoring stage includes a voltage detection circuit coupled to the input power supply, the voltage detection circuit providing control to the switching stage such that the switching stage permits delivery of power to the lamp when voltage characteristics of the input power source meet the predetermined criteria.

57. The ballast of claim 56, wherein the voltage detection circuit includes a voltage level detection circuit which provides the control to the switching stage such that the switching stage permits delivery of power to the lamp when a peak voltage of the input power source is at or above a predetermined value.

58. The ballast of claim 57, wherein the voltage level detection circuit includes a voltage divider circuit coupled to a threshold detector circuit, the threshold detector circuit providing the control to the switching stage.

59. The ballast of claim 58, wherein the voltage divider circuit includes a resistor divider network and the threshold detector circuit includes a Zener diode, the Zener diode conducting current and providing the control to the switching stage such that the switching stage permits the delivery of power to the lamp when the peak voltage of the input power source is at or above the predetermined value.

60. The ballast of claim 59, wherein the predetermined value is about 110 V.

* * * * *